US006077178A

United States Patent [19]

Brandt

[11] Patent Number: 6,077,178

[45] **Date of Patent: *Jun. 20, 2000**

[54] STRIKING IMPLEMENT

[76] Inventor: Richard A. Brandt, 34 Quail Run, Hampton Bays, N.Y. 11946

[ * ] Notice: This patent issued on a continued prosecution application filed under 37 CFR 1.53(d), and is subject to the twenty year patent term provisions of 35 U.S.C. 154(a)(2).

[21] Appl. No.: 08/990,294

[22] Filed: Dec. 15, 1997

[51] Int. Cl.[7] ..... A63B 59/06

[52] U.S. Cl. ..... 473/520; 473/566; 473/567

[58] Field of Search ..... 473/519, 520, 473/564, 565, 567, 568, 566, 332, 333, FOR 105, FOR 169, FOR 170

[56] References Cited

U.S. PATENT DOCUMENTS

| | | | |
|---|---|---|---|
| 3,703,290 | 11/1972 | Wilson | 473/566 |
| 3,861,682 | 1/1975 | Fujii | 473/566 |
| 3,877,698 | 4/1975 | Volpe | 473/566 |
| 3,963,239 | 6/1976 | Fujii | 473/566 |
| 4,951,948 | 8/1990 | Peng | 473/520 |
| 5,511,777 | 4/1996 | McNeely | 473/520 |

FOREIGN PATENT DOCUMENTS

| | | | |
|---|---|---|---|
| 405023407 | 2/1993 | Japan | 473/FOR 17 |

*Primary Examiner*—Michael O'Neill
*Assistant Examiner*—John M. Hotaling, II
*Attorney, Agent, or Firm*—Maxim H. Waldbaum; Meir Y. Blonder

[57] ABSTRACT

An improved striking implement is provided. The striking implement includes an essentially cylindrical metal shaft having a central cavity. A massive load is disposed within the central cavity at some distance from the upper end of the implement. When the striking implement is swung to contact an object to be struck, the load imparts a secondary impact, additive to the primary impact of the shaft upon the struck object, thereby increasing the forcefulness of the blow as a whole. Appropriate choice of suspension means for the load and situating of the load and suspension means optimize the additional energy imparted to the struck object. In the case in which the implement is a sports bat for striking a ball such as a softball or baseball, significant increase in the speed with which a hit ball leaves the bat, and thus meaningful athletic performance enhancement, is attainable by using the cavity-loaded bat illustrated as an embodiment of the invention.

23 Claims, 7 Drawing Sheets

STRIKING IMPLEMENT

FIELD OF THE INVENTION

The present invention relates to an improved implement for striking an object. In the preferred embodiment, the present invention relates to a sports bat for striking a ball, for instance a softball or baseball.

BACKGROUND OF THE INVENTION

A range of implements for striking objects exists. Such implements include tools (e.g., hammers, mallets, rug-beaters, etc.) as well as weapons (e.g., cudgels, truncheons, shillelaghs, etc.). Various types of sports equipment are among the striking implements operating in a similar fashion, i.e., by imparting an impulsive force to a struck object. The object may be, for example, a softball or baseball struck by a bat. Most implements for striking, including sports bats, are typically for manual use by an individual, e.g., a batter in a softball or baseball game who swings the bat. Sports bats are generally elongated shafts or tubes, of essentially circular cross section, having a longitudinal axis running the length of the shaft from a lower gripping end to an upper striking end.

Given that the utility of striking implements, and sports bats in particular, lies in their ability when swung to impart an impulsive force to a struck object, it is generally desirable that a bat, for instance, operate to impart to a ball as great a force as practicable under the circumstances during the brief period in which the bat and ball remain in contact. Application of force correlates with transfer of energy because work—a form of energy—is expressed as a force applied over a distance. Force, in turn, varies as the time derivative of momentum. Accordingly, increasing the amount of force applied by a bat to a struck ball will increase the amount of momentum and energy transfer between the bat and ball. As such energy will include kinetic energy—that is, energy related to motion—increasing the kinetic energy imparted to the ball will tend to increase the velocity of the ball and likewise the distance the ball can travel. In the games of softball and baseball, as in many sports involving a ball or other struck object, such an increase in velocity and distance traveled is highly desirable from a competitive standpoint and can confer competitive advantage on a game participant able to achieve such an increase (although safety concerns may place practical limitations on the maximum velocity which it is desirable for a ball to be capable of attaining).

In addition to maximizing the ability of a bat to transfer force under game-playing conditions, it is, more generally, desirable to provide a bat which a player may swing with relative ease to achieve a desired forceful impact between bat and ball. However, as such impact becomes more and more forceful stresses on the bat grow greater and greater, and so it is important as well to provide a bat which is durable and not readily subject to permanent malformation or structural failure as a result of such repeated forceful impacts. Those of ordinary skill in the art are aware that minimizing the thickness of the bat wall particularly at the anticipated point of bat-ball contact, proves advantageous because it maximizes the compression of the bat upon impact vis á vis the compression of the ball. Thicker bat walls do not compress as readily as thin walls, and, as compared to a thin bat wall in a collision between a thick bat wall and a ball, proportionately more of the compression which occurs takes place on the ball rather than the bat. This result is undesirable because ball compression and decompression results in significantly greater energy loss (e.g., as heat) than does bat compression and decompression. Accordingly, providing a bat wall thin enough to maximize bat compression vis á vis ball compression, but able to withstand structurally the repeated bat-ball impacts expected in normal use, would be an advantage over most known bats.

Currently-used softball bats may be made of metal, in particular, aluminum, for example C405 aluminum, which can also be used in construction of the bat of the instant invention. Currently-used bats have shell weights (i.e., the weight of the hollow aluminum shaft making up the exterior of the bat) of about 22 oz., but the most effective bat weight is known to be 28–30 oz. Substantially all existing bats increase the weight to this level by adding a load of 6–8 oz. to the end of the bat ("end loading"), embedded in a solid material (usually polyurethane).

Those in the sports equipment art have from time to time made various attempts to optimize bat design and performance. U.S. Pat. No. 514,420 to Jacobus disclosed a wooden bat having a carved-out axial portion into which one could place, for instance, ball bearings. Jacobus asserted such an arrangement would have two advantages: (A) easing strain on a batter's wrists while he waited for a pitch, as the ball bearings would be disposed in a lower position within the hollow and presumably exert less torque on the batter's wrists (torque being proportional to the distance at which a weight lies from a pivot point); and (B) increasing the (angular) momentum of the bat during a swing by allowing the ball bearings to move toward the upper end of the bat, thus enabling a more forcible blow. However, such an increase in angular momentum would result only from the application of additional exertion by the batter, as the bat would grow progressively more difficult to swing the further out the ball bearings moved along the axis.

Shroyer U.S. Pat. No. 1,499,128, teaches an all metal bat asserted to be more durable than wooden bats. The bat is hollow and has internal reinforcements for protection of the bat wall from the force of ball impact. Shroyer makes provision for a threaded axial aperture in the upper end of the bat, wherein a weight insert for adjusting the total bat weight to a desired value may be fixedly screwed.

Owen et al., U.S. Pat. No. 3,116,926, discloses a bat designed for developing a batter's wrist and arm strength by weighting the outer end of the bat, so as to increase torque about the batter's wrists and increase the effort required to swing the bat with a particular amount of angular momentum. Weights are fitted snugly into an axial chamber at the upper end of the bat and locked in place between an axial spring and a locking end-cap.

Johnson, U.S. Pat. No. 2,379,006, discloses (but does not claim) axial weight inserts snugly-fitted into a core portion of a bat formed of wood veneer, the inserts intended to balance the bat.

Fujii, U.S. Pat. No. 3,861,682, teaches a metal bat having a hard plastic insert disposed within for arresting the loud unpleasant metallic sound associated with impact of a metal bat. It also discloses an embodiment in which a metallic cylindrical repelling insertion member is provided in the inner periphery of the metallic bat shaft for structural reinforcement and sound arresting at the area of ball impact on the bat.

Peng, U.S. Pat. No. 4,951,948, discloses a bat asserted to provide superior shock absorption for prevention of injury to a batter. Peng uses a two-piece bat construction wherein a central handle portion is inserted into a main body portion, the two portions being connected at the upper end of the bat by a spring and snugly held by a retaining collar and elastic ring, or a gas bladder. The elastic retainer or gas bladder is asserted to provide a rebounding impulse force to the struck ball in that it compresses and then decompresses, thereby releasing upon decompression energy absorbed from ball impact shock.

Finally, Lewinski et al., U.S. Pat. No. 5,452,889, discloses a toy bat comprising a transparent shell partially filled with liquid for a splashing visual effect. Improved ball-striking characteristics are asserted to accrue from the centrifugal motion of the liquid toward the upper bat end during swinging.

In addition, efforts to evaluate and classify the performance of bats have demonstrated that certain analytical parameters are important for characterizing the ball-bat interaction in both a laboratory and a game setting. These parameters include basic physical quantities and locations such as the angular momentum, kinetic energy, and moment of inertia of the bat and the location of its Center of Percussion (the "COP", also correlated with the so-called "sweet spot" of the bat, i.e., the most desirable region on the bat surface for effectively hitting the ball), as well as derived parameters such as "coefficients of restitution" (CORs) for the bat and ball, as well as a "Bat Performance Factor" ("BPF"). A fuller description of a method and apparatus for defining and determining these and other parameters relating to the performance of a softball or baseball bat or similar sports equipment is found in my U.S. Pat. No. 5,672,809 (the "'809 Patent"), which I incorporate herein by reference.

As will be described more fully below in connection with certain comparative tests, based on computerized models and other evaluation methodologies related to my above-referenced bat testing method patent, I have found that existing attempts to improve bat performance do not achieve optimal results in terms of maximizing energy transfer from bat to ball so as to increase hit ball speed, making it comparatively easy for a batter to swing the bat rapidly to achieve a high angular momentum, and maximizing durability of the bat.

In particular, the above-described prior art patents reveal some attempts to achieve a more advantageous weight distribution within a bat, typically by providing weights at or near the upper end-cap of a bat (end loading), or located slightly below the end cap on the longitudinal axis in the interior of the bat. These weights may be rigidly fixed or in some cases movable along the longitudinal axis. Weights so situated do not optimize momentum or energy transfer upon striking a ball. Further, axially movable weights, to the extent they move out along the axis toward the upper end of the bat, tend to increase the moment of inertia of the bat, thus increasing the exertion a batter must apply to accelerate the bat for a powerful swing. Finally, while certain rigid or semi-rigid inserts exist for noise suppression and perhaps increasing durability of the bat, these known inserts do not provide significant momentum-transfer enhancement or facilitation of high-momentum swinging by the batter, and may, in fact, actually reduce momentum transfer.

SUMMARY OF THE INVENTION

An object of this invention is to provide an improved implement for striking an object.

Another object of this invention is to provide an improved sports bat for striking a ball in a game.

A further object of this invention is to provide an improved baseball or softball bat, capable of being readily swung with a high degree of momentum by a batter, capable of imparting high levels of such momentum and of energy to a ball when the ball is struck, thereby conducing to rapid travel of the ball and increased hit distances, and durable under repeated impact conditions.

In accordance with these objects and the present invention, there is provided a striking implement having an advantageously-disposed load or mass inside a hollow shaft having a longitudinal axis. The load can be engaged with the inner walls of the shaft so that it is free to move radially with respect to the longitudinal axis of the bat shaft. In a sports bat, the axial positioning of the load can yield significant improvements in the bat speed achievable with a given exertion by a batter. Further, when the bat strikes the ball, the load can impart a secondary or additional impact to the ball, transmitted through the wall of the shaft shortly after the shaft strikes the ball. In one highly advantageous embodiment, the containment of the load in an appropriately-chosen resilient elastomeric load carrier optimizes energy transfer. The pressure exerted by the moving load upon the bat wall during the period of forceful ball-bat contact provides reinforcement to the bat wall, preventing its malformation and increasing durability.

An additional advantage of the present invention is that it provides a bat with a larger "sweet spot." The sweet spot is the hitting area on the bat at which the best bat performance obtains.

BRIEF DESCRIPTION OF THE DRAWINGS

The above and other objects and advantages of the invention will be apparent upon consideration of the following detailed description, taken in conjunction with the accompanying drawings, in which like-reference numerals refer to like-parts throughout, and in which.

DETAILED DESCRIPTION OF THE INVENTION

Figure 1:
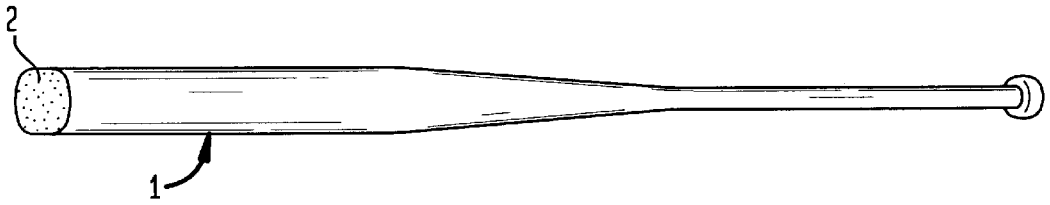
FIG. 1 (PRIOR ART)
FIG. 1 illustrates a prior art metal or composite softball bat.

FIG. 1 is an exemplary diagram of a prior art softball bat. The bat comprises a metal or composite shaft 1 of circular cross section having a central cavity. An endcap 2 made of for instance, a polyurethane-encased metal mass is inserted to close the upper end of the shaft and to add an additional mass of six (6) to eight (8) ounces to achieve the most desirable total bat weight, i.e., about twenty-eight (28) to thirty (30) ounces. The central cavity of the bat is essentially empty.

Figure 2A:
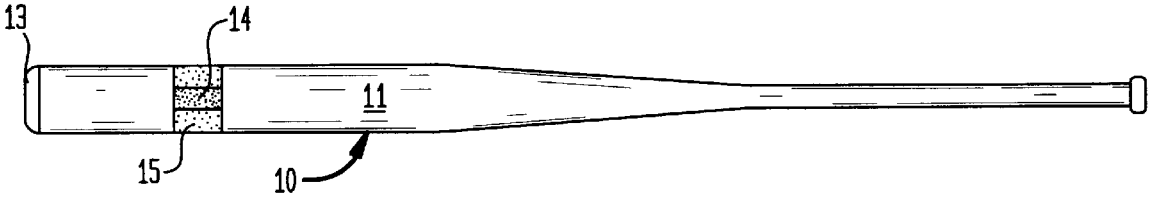
FIG. 2A (PRIOR ART)
FIG. 2A illustrates a first embodiment of the present invention, i.e., a metal bat having a central cavity with a load disposed within the cavity by embedding it in an elastomeric ring snugly fit within the cavity at a point somewhat interior to the upper end cap of the bat.
Figure 2B:
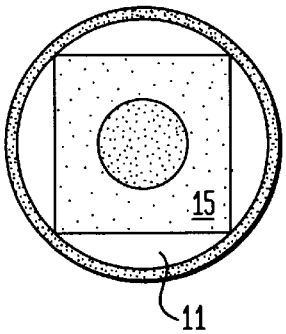
FIGS. 2B and 2C provide two further exemplary embodiments of a bat having a load encased in an elastomeric carrier which is engaged with the inner bat wall at a point somewhat interior to the upper end cap of the bat.
Figure 2C:
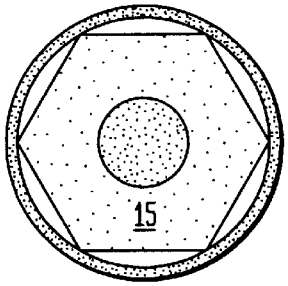

FIGS. 2A–2C illustrate the preferred embodiment of the present invention.

FIG. 2A provides an illustrative view of one particularly preferred embodiment of the present invention. The bat of FIG. 2A comprises a hollow metal shaft 10 having a central cavity 11. The bat is of essentially circular cross section and is made from, e.g., aircraft-quality aluminum. Other suitable materials for the construction of the bat of the instant invention include composite materials, e.g., certain fiberglass or carbon- or graphite-fiber materials. The shaft of an aluminum bat has a thin metal wall whose thickness varies along the length of the bat. The shaft is formed by a swaging or extrusion-like process from a tube of initially-uniform diameter and wall thickness, which accounts for part of the variation in the resultant bat wall thickness. Further milling is performed upon the swaged shaft to achieve desired shaft diameter and wall thickness as is known to those of ordinary skill in the art.

An endcap 13 closes the upper end of the shaft. The endcap comprises polyurethane, for example, but unlike the endcap of the prior art bat, no additional mass is added to the polyurethane of the endcap, which accordingly weighs only about one ounce.

Instead of placing the desired extra mass in the endcap, the bat of FIG. 2A places it in a metal load 14 situated roughly one-fifth of the length of the entire bat shaft from the upper capped end of the bat. This load may be, for instance, an iron alloy cylinder of diameter one inch, the iron alloy having a specific gravity of about 8.0. The length of the load may vary from about 0.4 inches to 1.5 inches, and the load length per se is not an important variable except as it affects the total load weight.

The load is situated coaxially with the longitudinal axis of the bat shaft, i.e., it is placed directly in the center of the cylindrical shaft. It is held in this location by a load carrier 15 of an elastomeric material, for instance rubber. The rubber load carrier may have length equal to the length of the metal load, or may be longer than the load. In a preferred embodiment, the rubber is a synthetic rubber having a specific gravity of 0.9 and an elastic modulus of around 1000 psi.

The elastic modulus of a material determines its compressability. The elastic modulus of the elastomeric load carrier will vary depending on the particular variety of rubber, for instance, chosen. Those of ordinary skill in the art will apprehend that the performance increase of the present invention is obtainable even with the use of high compression rubber, which will permit an enclosed metal load to move only a very small distance during bat-ball impact. Performance enhancement remains possible even in this situation, in which the load displacement decreases, because the load speed will simultaneously increase, leading to a performance enhancing effect which remains significant despite the high compression of the rubber load carrier.

Proper selection of the elastomeric load carrier material to be used in connection with a particular bat shaft will ensure that the desired effect of the invention is achieved, i.e., the imparting of a secondary impact from the load unit to the ball shortly after the contact between the outer bat shaft wall and the ball. Further details regarding the principles and best methods currently known for assembling appropriate load units appear hereinafter.

The load is embedded within the rubber load cylinder, which is injection molded with a diameter of about 2.3 inches. The rubber cylinder and embedded iron alloy load form a load unit having an aggregate weight which may be from about two ounces to about eight ounces depending on the desired total bat weight to be achieved. Increases in the load unit weight provide commensurate increases in hit ball speed; however, a limit exists to the extent to which one can simply increase load unit mass to increase bat performance, inasmuch as the total bat weight typically is limited, for instance by the rules of sports governing bodies or by bat manufacturer standards, and by the need for sufficiently-high bat swing speeds.

An exemplary listing of dimensions found preferable for an iron load and rubber load carrier in connection with bats of various weights (formed by varying the total load unit weight, i.e., the weight of iron load plus rubber load carrier) in accordance with the present invention is shown in TABLE 1 below, with reference to an exemplary rubber load carrier having specific gravity of 0.9, and diameter 2.323 inches, and a weight of bat shell and its peripheral attachments of 23.5 ounces:

TABLE 1

| TOTAL BAT WEIGHT (oz.) | TOTAL LOAD UNIT WEIGHT (oz.) | IRON LOAD DIAMETER (in.) | IRON LOAD HEIGHT (in.) | IRON LOAD WEIGHT (oz.) | RUBBER LOAD CAR-RIER HEIGHT (in.) | RUBBER LOAD CAR-RIER WEIGHT (oz.) |
|---|---|---|---|---|---|---|
| 26.0 | 2.5 | 0.75 | 0.41 | 0.83 | 0.8 | 1.67 |
| 28.0 | 4.5 | 0.875 | 0.71 | 1.97 | 1.25 | 2.53 |
| 29.0 | 5.5 | 1.125 | 0.67 | 3.09 | 1.25 | 2.41 |
| 30.0 | 6.5 | 1.00 | 0.99 | 3.60 | 1.5 | 2.90 |
| 32.0 | 8.5 | 1.125 | 1.13 | 5.23 | 1.75 | 3.27 |

The load unit is inserted hydraulically into the bat shaft barrel, where it is engaged with the inner side of the bat wall, either frictionally or preferably by use of an adhesive bond. In a bat having a standard shaft length of thirty-four (34) inches, the load unit is optimally positioned so that its center, lengthwise, is located about four (4) to about seven (7) inches inside the bat shaft with relation to the capped upper end of the shaft. While this is the optimal location of the load unit for a standard thirty-four (34) inch long bat shaft, it will be understood that the load unit will supply performance enhancing characteristics, although to a less optimum degree, at any location within the shaft which is on the order of several inches below the capped upper shaft end.

For the standard-length bat, or for bats of any non-standard length, the most important consideration regarding siting of the load unit is that it be positioned reasonably close to the point along the bat shaft at which a ball to be struck is expected to contact the outer wall of the shaft, i.e., the "impact area". While the impact area will differ from player to player based upon varying bat swing speeds, those skilled in bat manufacturing are readily able to determine the location of the impact area for particular players and classes of players, and it is common for bat manufacturers to make a number of bat models having, among other differing characteristics, different impact areas to correspond to the traits, including swing speed, of different classes of players.

By positioning the load unit so that its center is close to the point along the longitudinal bat axis expected to correspond with ball impact, one can take advantage of the energy-transfer-enhancing and structural advantages of the present invention vis á vis the configuration of prior art bats having loads located at the extreme upper end of the bat shaft, which is located a significant distance from the anticipated impact area.

In order to obtain and optimize improved performance, it is essential to correlate the elasticity of the load carrier to the elasticity of the ball, or, more generally, to correlate the motion of the load to the motion of the ball so that the load moves toward the ball with an appropriate speed so as to cause a secondary impact transmitting load energy to the ball just as the ball leaves the bat. Such optimization requires a specific value of the load carrier elasticity, given the values of the other parameters for a particular bat and ball. Determination of this optimal load carrier elasticity is crucial, as improper selection of the load carrier elasticity may actually decrease bat performance vis á vis prior art bats rather than increasing it.

The advantages of the preferred embodiment of the present invention as illustrated in FIGS. 2A–2C arise largely from the fact that when the outer wall of the bat shaft initially strikes the ball, the bat shaft, in imparting a primary impact to the ball, surrenders kinetic energy to the ball and so immediately begins to experience a decrease in velocity. However, the load embedded in the elastomeric load carrier moves to some extent independently of the surrounding bat shaft.

In so moving, the load will forcefully compress, and transfer energy to, the elastomeric carrier, and thence to the inner bat wall, which in turn, under appropriate circumstances, transfers the energy of this secondary impact to the ball, still in contact with the bat. Computer modeling, and testing of bats in accordance with the methods of my '809 Patent, have established that provision of this secondary impact can yield an increase in hit ball speed of approximately three (3) miles per hour. This hit ball speed increase can provide a competitive advantage to a softball player.

The following exemplary discussion will illustrate the determination of proper load carrier elasticity in connection with this embodiment of the current invention.

The performance of a given bat may be specified by the velocity ratio q. q is the ratio of the velocities v'/v, where v is the velocity with which a ball impacts a stationary free bat and v' is the velocity with which such ball rebounds off the bat.

In terms of q, the speed S of a pitched ball having been centrally struck by such a bat is given by the formula $$S=V+(V+v)q \qquad \text{EQ. 1}$$

where V is the bat swing speed at the impact area (about seventy (70) miles per hour (mph) for a theoretical player) and v is the pitch speed (which may vary from about ten (10) mph for slow pitch softball to about ninety (90) mph for fast pitch softball). Typical values for slow pitch softball are V=70 mph, v=10 mph, and q=0.15, which yield a value of S=82 mph.

Figure 5:
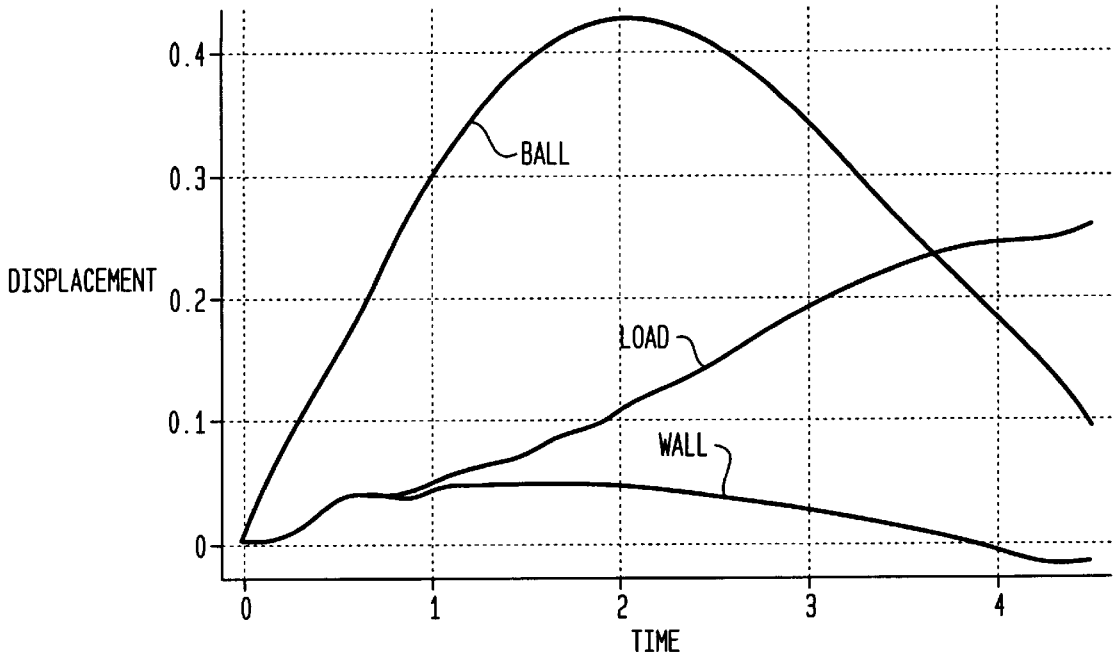
FIGS. 5–8 display computer-generated graphs of numerical analysis revealing the optimum relationship between elasticity of an elastomeric load carrier and bat performance for the bat embodiments of FIG. 2A.

The load is embedded in rubber or synthetic rubber having elastic constant k pounds per inch (ppi). In terms of the Young's modulus Y, cross-sectional area A, and length l of the rubber, k=YA/l. If k is allowed to be too small the ball-bat impact is, undesirably, as described in FIG. 5 which is based on computer modeling of an impact between a moving ball and a stationary bat (such modeled impact providing all of the information required for projecting actual game-condition bat-ball impacts, in view of the fact that for essentially all physical purposes, the closing speed or impact speed between the bat and ball is determinative of bat performance, without regard to the portion of impact speed attributable to the speed of the bat and the portion attributable to the ball speed). The horizontal axis of FIG. 5 is proportional to time after the initial impact, with one unit corresponding to approximately 0.5 milliseconds (ms). The vertical axis is proportional to displacement, with units approximately equal to inches. The upper curve shows the ball compression, seen to have a maximal value of about 0.43 inches at about 1 ms. The middle curve shows the motion of the load relative to the bat wall. Generally, at the instant the ball forcefully strikes the outer wall of the bat in the moving ball-stationary bat model, the load will move in a radial direction (with respect to the longitudinal bat shaft axis) away from the bat-ball impact area, i.e., toward the diametrically-opposite side of the bat shaft as the ball has just struck. In FIG. 5, the load is seen to move about 0.25 inches radially in a direction away from the ball during the bat-ball impact. The lower curve shows the bat wall compression. The wall is seen to move in toward the center of the cavity a distance of about 0.04 inches and then move back out. For this bat, q has the rather small value of 0.153 because in this case the motion of the load has actually taken energy away from the ball.

Figure 6:
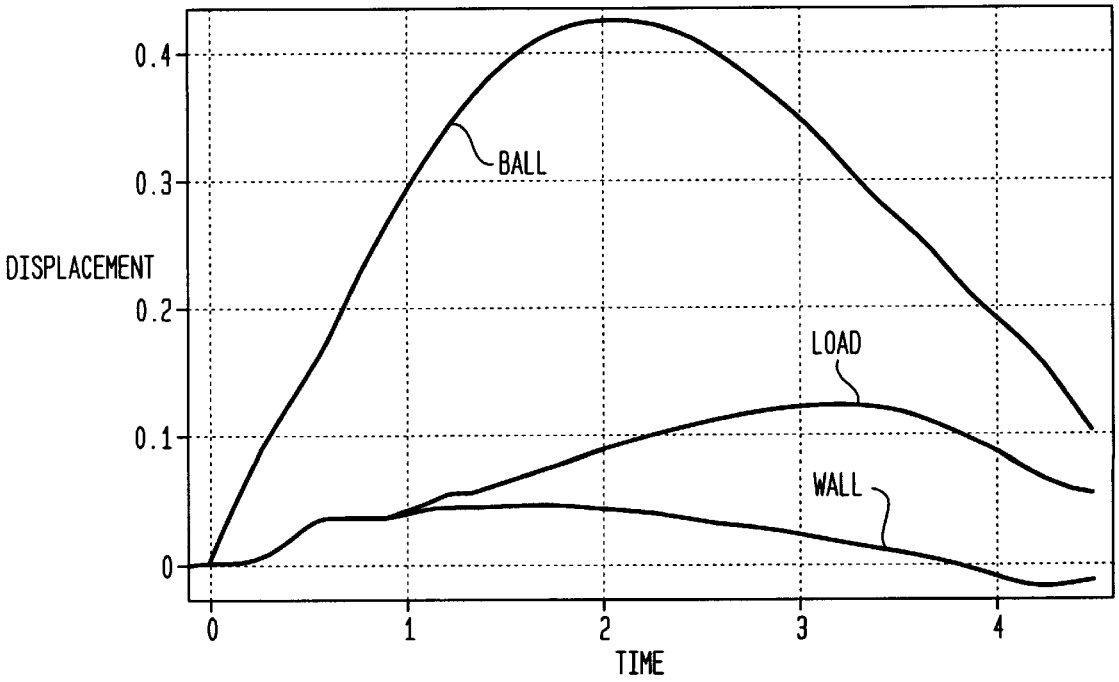

As the k value of the rubber increases, the load begins to 'turn around' during the modeled stationary bat—moving ball impact—i.e., its radial motion shifts from being motion entirely away from the ball impact area to being motion directed, at least during part of the impact period, toward the ball impact area. The load thus begins to impart energy to the ball. FIG. 6, based on computer modeling of the moving ball-stationary bat impact, illustrates this effect. Here it is evident that the load first moves radially away from the ball about 0.12 inches, but then returns back to move radially toward the ball before the impact ends. The q value has increased to 0.186 for this choice of rubber elasticity.

Figure 7:
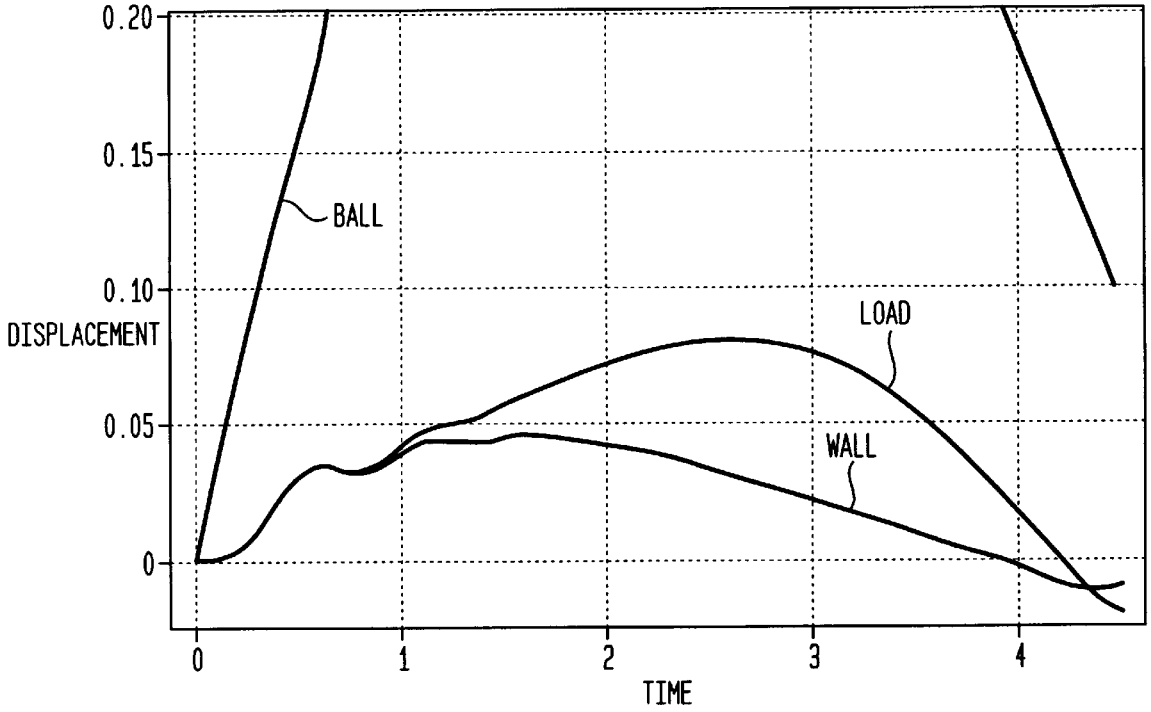

Increasing k further yields further performance improvements. The optimal choice is illustrated in FIG. 7, based on computer modeling for the moving ball-stationary bat test. It is seen that the load 'turns around' about half way through the impact, i.e., ceases to move radially away from the bat-ball impact area and begins moving radially toward the impact area. The q value is at its highest value of 0.194 for this bat.

Figure 8:
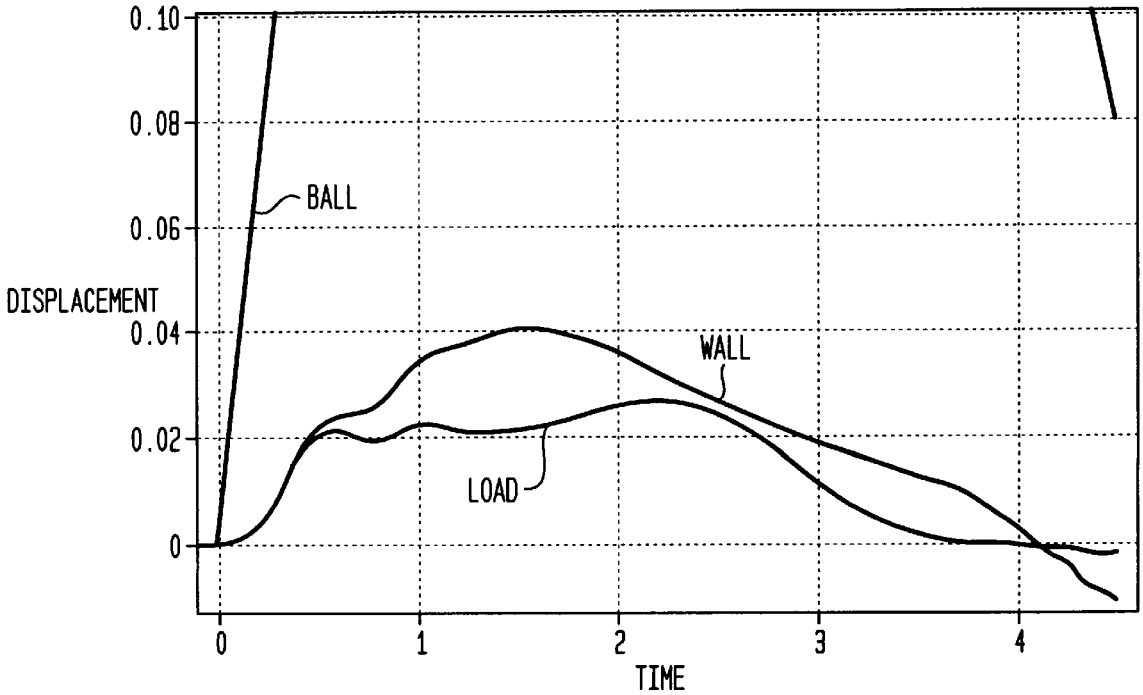

If k is increased still further, the bat performance begins to decrease because excessive load oscillation ensues. FIG. 8 illustrates this situation, wherein the q value has decreased to 0.185.

The optimal choice for the rubber elastic constant k depends on the ball properties (weight, coefficient of restitution or COR, and compression), the bat shaft properties (weight, shape, and wall thickness), and the weight of the load. Among these properties, the ball compression assumes greatest importance because, as FIGS. 5–8 make clear, the load motion must be in synchronization with the ball motion in order for optimal performance to ensue.

Ball weight for typical softballs approved by sports governing bodies is required to be about 6.5 ounces, and this value will be assumed in the ensuing illustrative calculations (although other values of ball weight are also considered hereinafter). The ball coefficient of restitution (COR) is usually about 0.5, but is required to be as low as 0.44 in some softball leagues and is about 0.54 for college baseball. The value 0.5 is assumed initially herein for illustrative purposes. The bat weight (including the load unit) is assumed to be 30 ounces, and the bat shaft wall will be taken to be 0.075 inches thick. The load unit weight is initially chosen at 3.9 ounces, but other values will be considered thereafter. The ball compression C is given as the pounds of force required to compress the ball one-quarter of an inch. In the past this compression was typically about 300 lbs., but more recently values as high as 500 lbs. have been common in commercially-available softballs. The value C=400 lbs. will be chosen initially for illustrative purposes. The optimal value of k depends strongly on C as will presently become apparent.

The dynamical equations governing the impact between the bat and ball may be numerically solved by computer analysis. The general techniques of computer-aided numerical analysis are well known in the mathematical, engineering, and computer-assisted-design arts. Upon solution of these dynamical equations, the result for the dependence of the performance q on the load carrier elasticity k and the ball compression C can be most conveniently expressed in terms of the dimensionless expression $$L=(0.0105)k/C^{2/3}. \qquad \text{EQ. 2}$$

In this expression, the dimension of k is ppi and the dimension of C is lbs., so that the dimension of the constant 0.0105 is [in/(lbs.$^{1/3}$)]. This gives the expression $$k=95.3\,LC^{2/3} \qquad \text{EQ. 3}$$

for k in terms of L and C.

Figure 9:
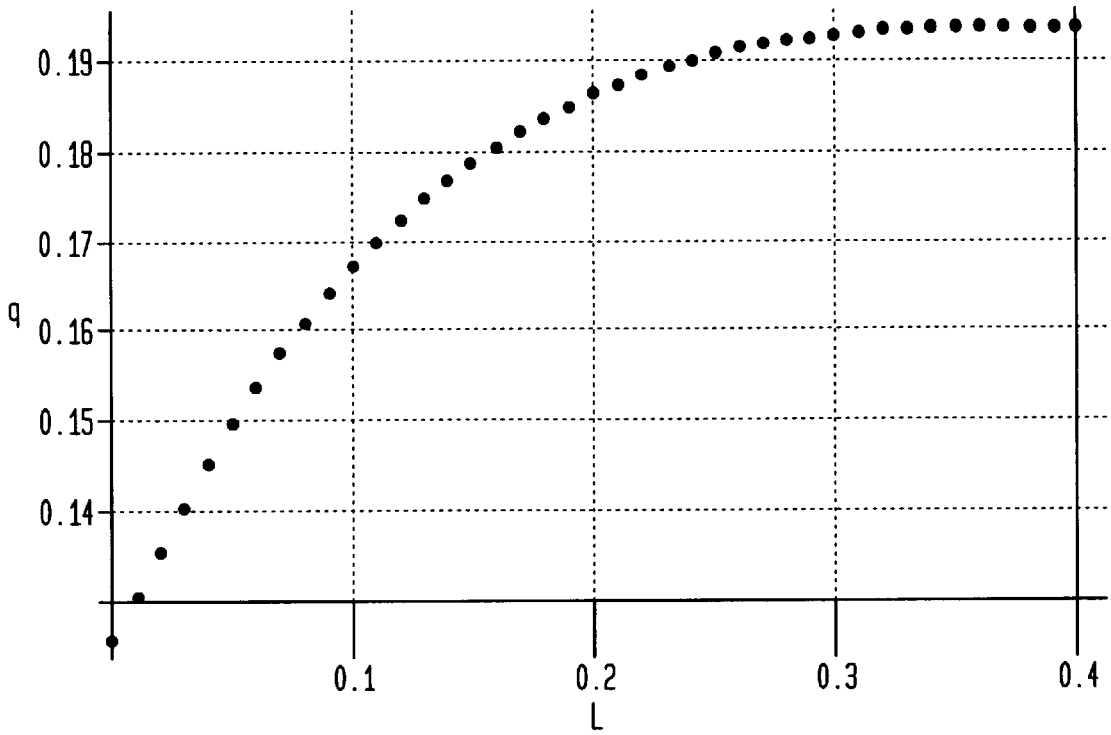
FIGS. 9–11 display computer-generated graphs of numerical modeling showing the effect of varying the weight of the load for the bat embodiment of FIG. 2A.

For the ball and bat described above with load weight 3.9 ounces, the q that results for a given value of L can be obtained from computer-generated graphs of q against L such as shown in FIG. 9. As L increases from 0 to 0.4, it can be seen from FIG. 9 that q increases from about 0.126 to about 0.194. In this range, the performance of the bat is thus seen to increase dramatically as L increases. If this same bat had a 3.9 ounce end load as found in the prior art instead of the movable central load of the present invention, the q value would be about 0.17. The movable load thus actualldecreases performances in the case in which L is less than y about 0.11 as q is then less than the prior art bat value of 0.17. This phenomenon has already been explained in connection with FIG. 5, which illustrates the case for L=0.06. In that instance of the moving ball-stationary bat modeled impact, the load was seen to move radially away from the ball during the entire impact time, and the q value of 0.153 was correspondingly small. In the case of FIG. 6, previously discussed, L=0.20. In this instance of the moving ball-stationary bat model, the load returns energy to the ball because it begins moving radially toward the ball during the impact period, and the q value of 0.186 is already significantly larger that that of the end-loaded prior art bat.

Figure 10:
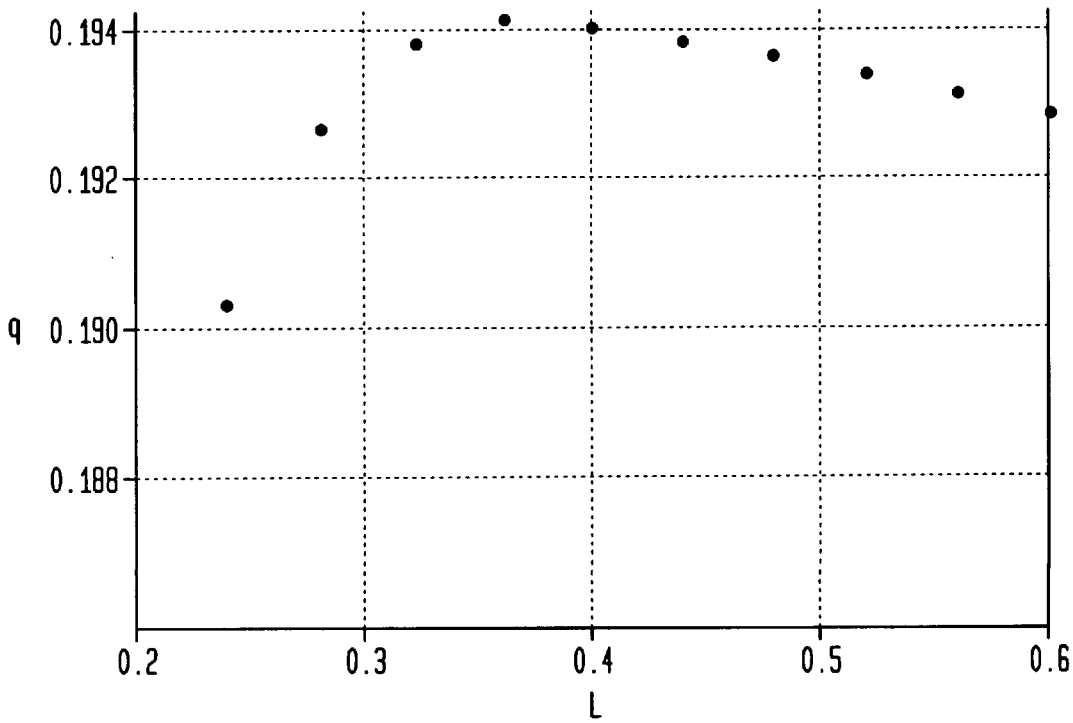
Figure 11:
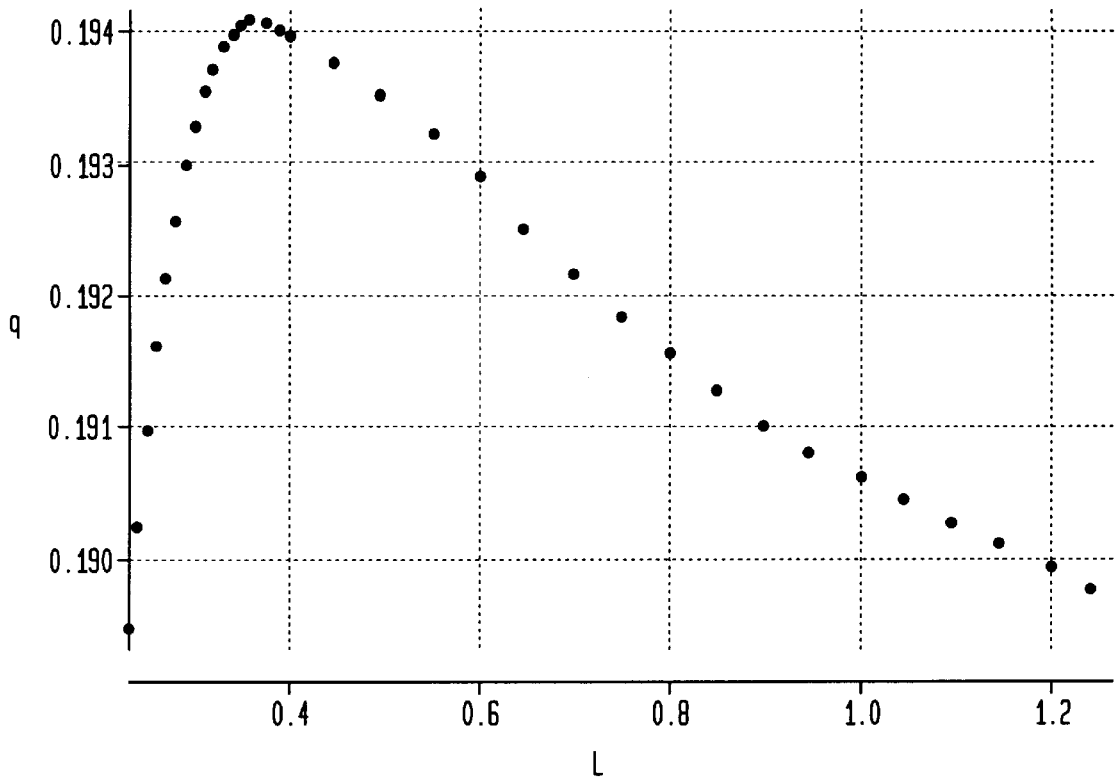

To determine the optimal value of L, it is necessary to study the q vs. L graph in greater detail. The q values for L between 0.2 and 0.6 are shown in FIG. 10. The optimal result (largest q value) is seen to occur for L=0.36. Further study of this region and the decrease in q for larger L values is possible in connection with FIG. 11. FIG. 11 details the region near the optimal L value of 0.36 and the corresponding maximum q value of 0.194. The ball, bat wall, and load motion in this case were shown and discussed previously in connection with the moving ball-stationary bat model illustrated in FIG. 7. The ball motion and load motion here are in perfect synchronization leading to this largest value of q. According to FIG. 11, the q value falls back to about 0.190 for L=1.2. This decreased-performance result based on unfavorable load oscillation as was shown and discussed previously in connection with the moving ball-stationary bat model illustrated in FIG. 8.

Given that the optimal L value is 0.36 for the above bat, the optimal rubber elastic constant k can be obtained from EQ. 3 for a given value of the ball compression C. For C=400, the optimal value of k is 1863 ppi. The corresponding values for the rubber elastic modulus can be readily obtained from the relation Y=kl/A in terms of the rubber length l and area A. The above results are summarized in the following TABLE 2:

TABLE 2

| FIGURE | L | k (ppi)(C = 400) | q | S (mph) |
|---|---|---|---|---|
| 5 | 0.06 | 310 | 0.153 | 82.2 |
| 6 | 0.20 | 1035 | 0.186 | 84.9 |
| 7 | 0.36 | 1863 | 0.194 | 85.5 |
| 8 | 2.50 | 12934 | 0.185 | 84.8 |

The above values for hit ball speed S are obtained from EQ. 1 with pitch speed v=10 mph and bat swing speed V=70 mph.

The above optimal value of 0.36 for L is for a load weight of 3.9 ounces. The optimal values for other choices of load weight, along with the corresponding optimal k and q values for ball compression C=300, 400, and 500 respectively, are set forth in the following TABLE 3:

TABLE 3

| LOAD WEIGHT (ounces) | OPTIMAL L | OPTIMAL k (ppi) (C = 300) | OPTIMAL q (C = 300) | OPTIMAL k (ppi) (C = 400) | OPTIMAL q (C = 400) | OPTIMAL k (ppi) (C = 500) | OPTIMAL q (C = 500) |
|---|---|---|---|---|---|---|---|
| 1.3 | 0.18 | 769 | 0.146 | 931 | 0.151 | 1081 | 0.155 |
| 2.6 | 0.30 | 1281 | 0.169 | 1552 | 0.173 | 1801 | 0.177 |
| 3.9 | 0.36 | 1538 | 0.189 | 1863 | 0.194 | 2164 | 0.198 |
| 5.2 | 0.46 | 1965 | 0.208 | 2380 | 0.213 | 2762 | 0.217 |
| 6.5 | 0.56 | 2392 | 0.225 | 2897 | 0.231 | 3362 | 0.235 |

The increase in q with load weight is apparent, but it must be kept in mind that heavier bats cannot be swung by a batter as fast as lighter ones (although the current invention, by placing the load some distance in from the endcap at which prior art bats typically placed the load, reduces the bat moment of inertia and so does enable a batter to swing a bat according to the current invention faster than a prior art end-loaded bat of the same weight). The optimal L and q values for other load weights can be found by interpolation from these values, and it is accordingly not necessary to describe in further detail the involved computer modeling techniques used to obtain the above-discussed exemplary results. The given k values are obtained from the L values using EQ. 3.

All of the above results hold for a ball COR of 0.50, but they are essentially independent of this COR value in the commonly-used COR range of 0.44 to 0.54. Likewise, the results are not sensitive to the bat shell parameters. Equations 2 and 3, given for softball as an example, do, however, depend on the ball weight of 6.5 ounces. For baseball, the ball weight is about 5.25 ounces, and then EQS. 2 and 3 become, respectively:

$$L=(0.0113)k/(C^{2/3})$$

and $$k=(88.7)LC^{2/3}.$$

The baseball compression is about 300 lbs. The optimal L values for a baseball bat in accordance with the present invention in connection with various choices of total load unit weight are given in the following TABLE 4, along with the corresponding k and q values for ball compression C=300.

TABLE 4

| TOTAL LOAD UNIT WEIGHT (oz.) | OPTIMAL L | OPTIMAL k (ppi) | OPTIMAL q |
|---|---|---|---|
| 1.3 | 0.21 | 835 | 0.240 |
| 2.6 | 0.36 | 1431 | 0.264 |
| 3.9 | 0.46 | 1829 | 0.278 |
| 5.2 | 0.58 | 2306 | 0.292 |
| 6.5 | 0.71 | 2822 | 0.304 |

FIG. 2B illustrates a further embodiment of a bat according to the present invention. The load 14 is once again embedded in an elastomeric load carrier 20, but as opposed to the cylindrical load carrier of FIG. 2A, a load carrier of generally square cross section is provided and is engaged with the inner wall of the bat shaft.

FIG. 2C illustrates a still further embodiment of the bat wherein the elastomeric load carrier 25 is of hexagonal cross section. Those of ordinary skill in the art will understand that numerous further embodiments employing elastomeric load carriers of appropriate shape are possible as long as the load is, when at rest, situated approximately along the longitudinal axis of the bat shaft and disposed roughly adjacent to the anticipated impact area, and the load unit is engaged with the inner bat wall.

In addition to the preferred embodiments of the instant invention discussed in connection with FIGS. 2A–2C, other embodiments of my invention are possible.

Figure 3A:
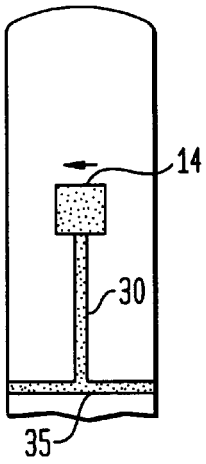
FIG. 3A is an exemplary illustration of a second embodiment of the present invention, i.e., a metal bat with a centrally-disposed load which is suspended by a flexible rod.

FIG. 3A illustrates one such additional embodiment of the present invention. Load 14 is chosen in accordance with the guidelines set forth in connection with the embodiments of the invention set forth in FIGS. 2A–2C, and is situated, in a resting position, along the longitudinal axis of the bat shaft at a point parallel to the anticipated impact area at which the outer bat wall is to contact the ball. The load is supported by longitudinal flexible rod 30, which is fixedly connected to support member 35, which is in turn engaged with the inner walls of the bat shaft. Upon swinging of the bat by a player, the load will, as in the embodiments of FIGS. 2A–2C, accelerate along with the bat shaft. Upon ball-bat impact, the bat shaft will experience negative acceleration while the load continues to move, broadly speaking, at undiminished speed until contacting the inner wall of the bat shaft. This secondary impact, taking place at or around the point of the bat wall at which the ball will make initial impact with the bat, will impart additional energy to the ball through the bat wall.

Figure 3B:
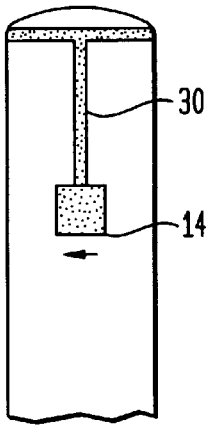
FIGS. 3B, 3C, and 3D illustrate three further embodiments of the rod-suspended central load bat embodiment of FIG. 3A.

FIG. 3B illustrates another embodiment of the instant invention employing a rod for suspension of the load. In this embodiment the longitudinal flexible rod 30 is attached to the upper endcap of the bat, but the function of the load is otherwise as in FIG. 3A.

Figure 3C:
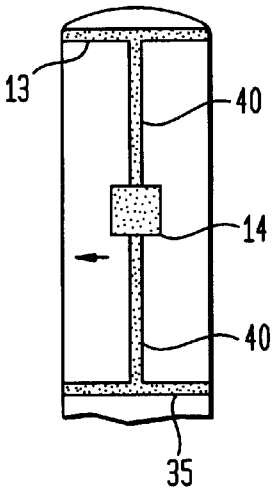

FIG. 3C illustrates yet another flexible-rod-mounted embodiment of the present invention, in which the load 14 is suspended at both ends by dual longitudinal flexible rods 40 attached to endcap 13 and support cross member 35.

Figure 3D:
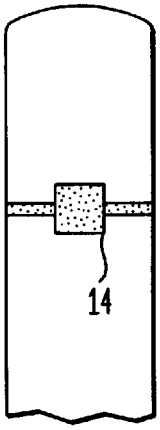

In FIG. 3D an embodiment of the instant invention is shown in which a flexible rod suspending a load in a central resting position is attached to the inner wall of the bat shaft so that attachment is radial with respect to the bat shaft rather than longitudinal. It is apparent that in such an embodiment, proper gripping of the bat is necessary to ensure that the load is free to move radially toward the impact area, i.e., that the bat is not gripped and swung in such a manner that the impact area on the outside wall of the bat shaft is at or around the point corresponding to the flexible rod attachment on the inner wall of the bat shaft.

Figure 4:
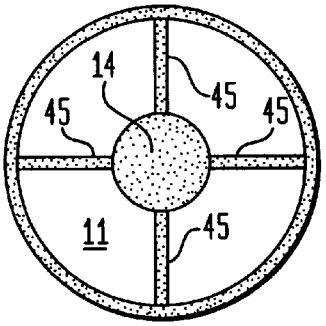
FIG. 4 illustrates an embodiment of the present invention utilizing spring means for suspension of a centrally-disposed load.

FIG. 4 illustrates a further embodiment in accordance with the present invention. Load 14 is suspended, when at rest, along the longitudinal axis of the bat shaft by springs 45. Secondary impact upon a struck ball is provided by appropriate positioning of the load and radial movement of the load toward the point of bat-ball impact as in the previously-illustrated embodiments.

Those of ordinary skill in the art will appreciate that a number of other embodiments for positioning a load within the bat shaft cavity for imparting a secondary impact to a struck ball by transmitting kinetic energy through the bat wall are possible. For instance, the flexible-rod-mounted embodiments of FIGS. 3A–3C could be modified by substitution of pivot-mounted rigid rods wherein the rods and loads were restored to an axial equilibrium position by appropriately-provided spring means rather than by the resiliency of the rods as was the case in the embodiments of FIGS. 3A–3C.

It will be evident to those of ordinary skill in the art that in connection with all the embodiments discussed in connection with FIGS. 2A–4 that the secondary impact of the appropriately-chosen and -disposed load (and, in the case of FIGS. 2A–2C, the load carrier as well) serves the additional purpose of lessening the inward deformation of the bat shaft wall expected upon bat-ball impact. This result achieves the desired object of reinforcing the bat wall, permitting thinner bat walls for maximizing energy transfer, and increasing durability of the bat.

The bat of the present invention also has the advantage of possessing a larger sweet spot than most conventional bats. The sweet spot is, as discussed, the zone in which most advantageous hitting of the ball may be achieved. It must be recognized that the location of the sweet spot is a player-dependent parameter. For any given bat, the sweet spot location will be different for different hitters. The hitter dependence is, however, rather limited and so it is convenient to specify the sweet spot in terms of the hitting characteristics of a typical player. For such a player, there exists a unique point on the bat (actually a circle around the bat barrel a unique distance from the bat end) where the hit ball speed will be maximal (for a given pitch speed). This point may be referred to as the "maximal hit speed" (MHS) point. The sweet spot can then be defined as the area around this MHS point at which the HBS is within, say, five percent (5%) of the maximum HBS.

Figure 12:
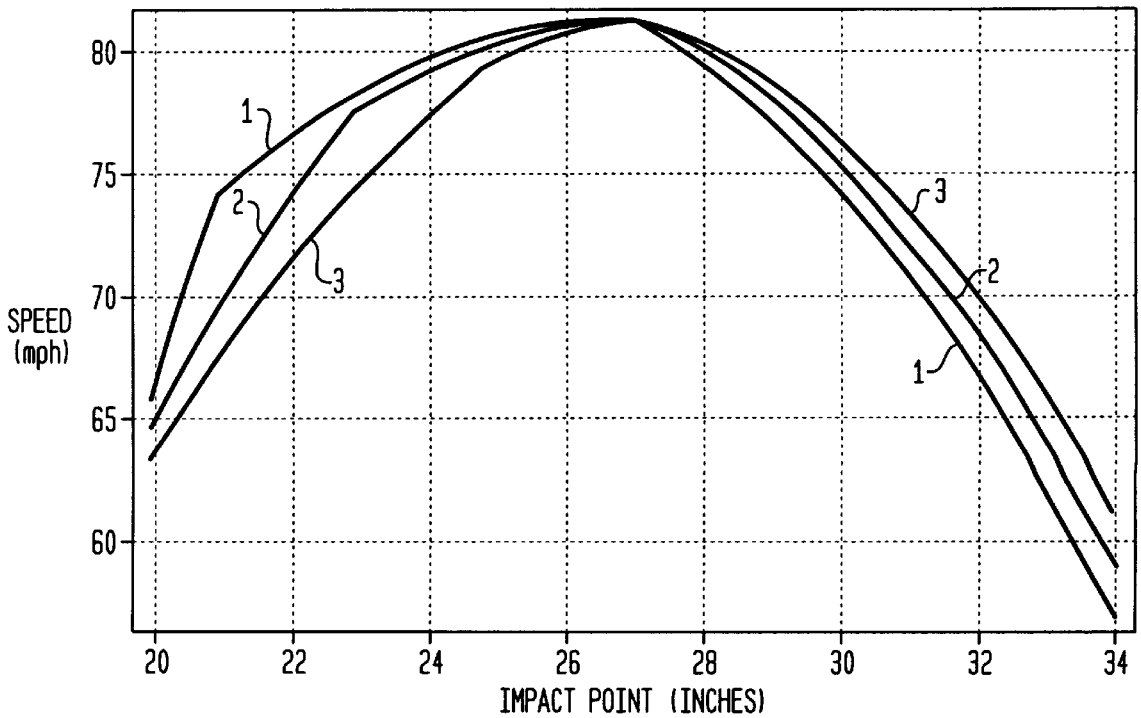
FIG. 12 displays computer-generated graphs of hit ball speed against impact point for various bats constructed in accordance with the instant invention, illustrating the varying sweet spot locations and consequent performance improvements associated with varying placement of the central load inward from the upper barrel end of the bat.

For the class of bats disclosed herein having radially movable central loads, the position of the load within the barrel of the bat determines the location and size of the sweet spot. In general, as one situates the load at positions increasingly inward from the upper barrel end toward the lower handle end of the bat, the size of the sweet spot increases and the location of the sweet spot shifts toward the handle end. This is illustrated in FIG. 12, which plots computer generated graphs of HBS versus the distance of the impact point from the lower handle end of a thirty-four inch (34") bat. Curve No. 1 is for a 5.5 ounce load centered at 6.0 inches from the upper barrel end, whereas the load is at 4.0 inches from the upper barrel end for curve No. 2 and is at 2.0 inches from the upper barrel end for curve No. 3. The sweet spot size is seen to be very large in each case. The HBS is above eighty (80) mph for a distance from upper barrel end of 5.0 inches in curve No. 2 and also for a distance from upper barrel end of 4.0 inches in curve No. 3, but among the three load locations described in connection with FIG. 12, the location 4.0 inches inward from the upper bat barrel end (curve No. 3) is most preferable because it provides the best compromise between sweet spot size and location.

Figure 13:
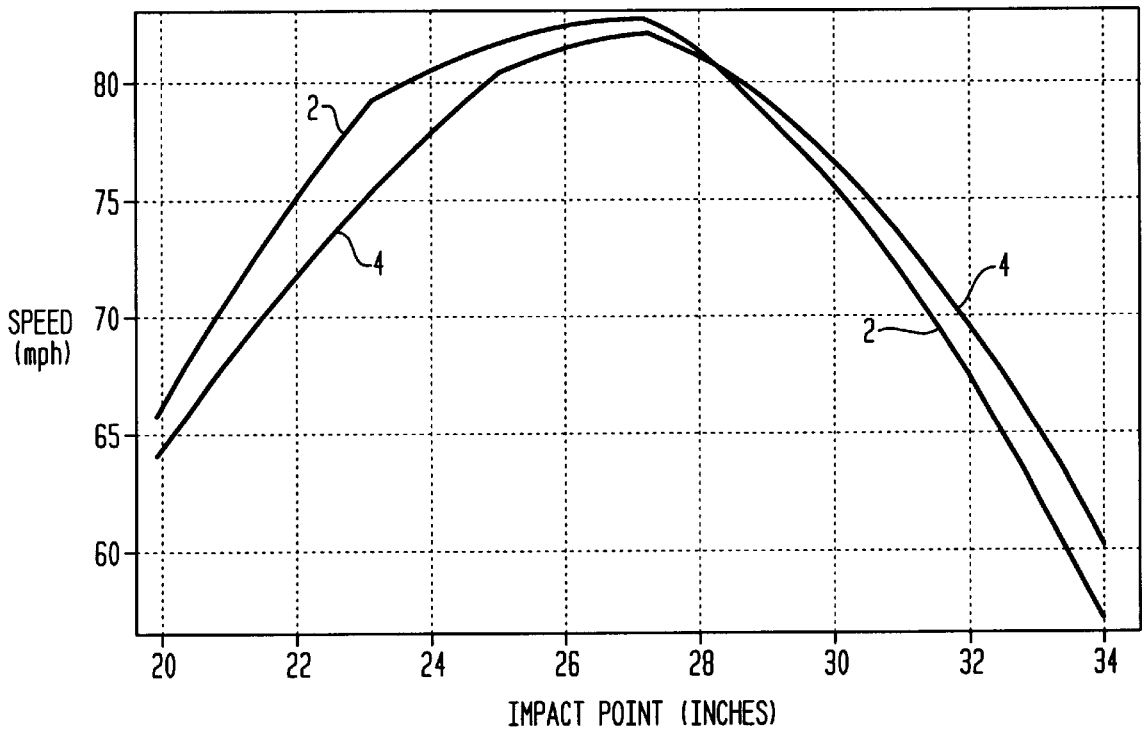
FIG. 13 displays computer-generated graphs of hit ball speed against impact point for a bat according to the present invention and a conventional bat of the prior art, illustrating improved hitting characteristics obtained by virtue of the larger sweet spot of the bat of the present invention.

In any event, it will be noted that the sweet spot sizes indicated in each of these graphs for exemplary bats of the present invention is at least twenty-five percent (25%) larger than the sweet spot sizes which obtain in conventional end-loaded bats of the same weight. FIG. 13 illustrates this fact; the Figure compares the HBS curve No. 2 from the above-discussed FIG. 12 with the corresponding curve (curve No. 4) for a conventional end-loaded bat of the same weight. The improvement in performance obtained from the sweet-spot-enhancing technology of the present invention will be readily apparent to those of ordinary skill in the bat design art, and indeed to all experienced players.

It will also be evident from the above discussion in connection with sports bats, which comprise the preferred embodiments of the instant invention, that the present invention could also be applied to improve performance of other implements for striking, for instance implements such as those discussed in the Background of the Invention.

Thus, I have disclosed herein an improved striking implement. Those skilled in the art will appreciate that the present invention can be practiced by other than the described embodiments—which are presented here for purposes of illustration and not to limit the spirit and scope of my invention—and that the present invention is limited only by the claims that follow.

I claim as my invention:

1. A bat for striking an object, comprising:

(a) an elongated shaft of unitary construction having a barrel shaped wall, a central cavity defined by the inside of said barrel shaped wall, a longitudinal axis and a handle at one end of said elongated shaft; and (b) a load disposed within said central cavity and connected to said walls of said central cavity and radially movable with respect to said longitudinal axis of said shaft wherein said load is at least in part defined by an elastic constant k such that upon said bat striking said object, wherein said object will compress and then rebound, said load will move with a velocity in the direction of rebound of said object during said rebound of said object.

2. The bat of claim 1, wherein said elongated shaft is of substantially circular cross-section.

3. The bat of claim 2, wherein said shaft has a lower portion for gripping and an upper portion for striking said object.

4. The bat of claim 3, wherein said lower and upper portions each have a closed end.

5. The bat of claim 4, wherein at each point along its length said elongated shaft has a diameter slightly greater than the diameter of said central cavity at said point, whereby a thin bat wall having an inner side and an outer side is defined.

6. The bat of claim 5, wherein said elongated shaft is made from a substance selected from the groups consisting of metals, metal alloys, and composite materials.

7. The bat of claim 5, wherein said radial motion of said load imparts a force to said inner side of said bat wall whereby said force imparted by said load is transmitted to said struck object.

8. The bat of claim 7, wherein said load is located near a first point on said longitudinal axis where said longitudinal axis intersects with a line, said line being perpendicular to said longitudinal axis and being defined by said first point and a second point, said second point being located on the outer side of said bat wall where said object is expected to be struck with said outer side of said bat wall.

9. The bat of claim 7, wherein the distance between said closed end of said upper portion of said bat and said striking point on said outer side of said bat wall is about one fifth the length of said elongated shaft.

10. The bat of claim 7, wherein said load has a mass about one third the mass of said elongated shaft.

11. The bat of claim 1, wherein said load is supported in said central recess by resilient attachment means engaged with said elongated shaft.

12. The bat of claim 11, wherein said resilient attachment means comprises an elastomeric medium in which said load is substantially embedded.

13. The bat of claim 11, wherein said resilient attachment means comprises a flexible rod.

14. The bat of claim 11, wherein said resilient attachment means comprises a rod mounted on a pivot.

15. The bat of claim 11 wherein said resilient attachment means comprises a spring attachment.

16. A bat in accordance with claim 1 wherein said load further comprises an elastic constant k, such that said velocity of said load during said movement will approach a maximum value in the direction of rebound of said object.

17. A bat for striking an object, comprising:

(a) an elongated shaft having a barrel shaped wall, a longitudinal axis, a top end cap and a cavity defined by the inside of said barrel shaped wall and top end cap;

(b) a load disposed within said cavity;

(c) at least one flexible rod connected to said load; and (d) means for fixedly attaching at least one end of said flexible rod to one wall of said cavity, wherein said load is radially movable with respect to said longitudinal axis of said shaft.

18. A bat according to claim 17 wherein said flexible rod is engaged with said walls and lies on an axis perpendicular with said longitudinal axis.

19. A bat for striking an object comprising:

(a) an elongated shaft having a barrel shaped wall, a longitudinal axis, a top end cap, a cavity defined by the inside of said barrel shaped wall and top end cap and a handle at an end of said shaft opposite to said top end cap;

(e) a load disposed within said cavity;

(f) at least one support member connected to said wall of said cavity; and (g) at least one flexible rod connected to said load and to said support member, wherein said load is radially movable with respect to said longitudinal axis of said shaft.

20. A bat according to claim 19 wherein said flexible rod depends downward from said support member and coaxial with said longitudinal axis.

21. A bat according to claim 19 wherein said flexible rod extends upward from said support member and coaxial with said longitudinal axis.

22. A bat according to claim 19 wherein said at least one support member comprises:

(a) a first support member engaged with said inner surface of said walls proximate to said top end cap; and (b) a second support member engaged with said inner surface of said walls distal from said top end cap, wherein said flexible rod extends between said first and second support members and coaxial with said longitudinal axis.

23. A bat for striking an object, comprising:

(a) an elongated shaft having a barrel shaped wall, a longitudinal axis, a top end cap and a cavity defined by the inside of said barrel shaped wall and top end cap;

(b) a load disposed within said cavity; and (c) at least two springs, each of said springs engaged with the inside of said wall within said cavity and connected to said load, wherein said load is radially movable with respect to said longitudinal axis of said shaft.

* * * * *